US005477968A

United States Patent [19]

Largent et al.

[11] Patent Number: 5,477,968

[45] Date of Patent: Dec. 26, 1995

[54] SELF-SUPPORTING RACK SYSTEM FOR STORAGE, PROTECTION AND DISPLAY OF SPORTS EQUIPMENT

[76] Inventors: Kevin C. Largent; Susan A. Largent, both of 10319 Clusterberry St., Los Angeles, Calif. 90077

[21] Appl. No.: 222,248

[22] Filed: Apr. 4, 1994

[51] Int. Cl.[6] ..... A47F 7/00

[52] U.S. Cl. ..... 211/60.1; D6/552; 211/70.5; 211/204

[58] Field of Search ..... 211/13, 60.1, 70.5, 211/175, 204, 206; D6/552

[56] References Cited

U.S. PATENT DOCUMENTS

| | | | |
|---|---|---|---|
| 1,008,477 | 11/1911 | Kohn | 211/204 |
| 2,533,324 | 12/1950 | Mendle | 211/206 |
| 3,164,256 | 1/1965 | Bennett | 211/70.5 |
| 3,338,422 | 8/1967 | Hickock | 211/204 X |
| 3,341,028 | 9/1967 | Nichols | 211/204 |
| 3,532,224 | 10/1970 | Grubb et al. | 211/206 |
| 4,078,708 | 3/1978 | Mayer | 211/70.5 X |
| 5,044,505 | 9/1991 | Spratt | 211/13 X |

*Primary Examiner*—Robert W. Gibson, Jr.
*Attorney, Agent, or Firm*—Allan M. Shapiro

[57] ABSTRACT

The self-supporting rack system is comprised of at least two substantially upright and parallel side bars, each having its own foot to support the side bars at a small angle to the vertical. Two cross bars are attached to each side bar to form the rack. Sports equipment is supported on the side bars and cross bars for storage, protection and display. Attachment means such as hooks and/or platforms assist in supporting some types of sports equipment.

7 Claims, 3 Drawing Sheets

10
12
14
16
18
20
22
24
26
28
30
32
34
36
38
40
42
44
46
48
50
52
54
56
58
60
62
64
66
68
70
72
74
76
78
80
82
84
85
86
88
90
92
94
95
96
97

SELF-SUPPORTING RACK SYSTEM FOR STORAGE, PROTECTION AND DISPLAY OF SPORTS EQUIPMENT

FIELD OF THE INVENTION

This invention is directed to a rack system which is supported on the floor configured for the detachable attachment of sports equipment for the storage, protection and display of the sports equipment.

BACKGROUND OF THE INVENTION

Much sports equipment is difficult to store. Some such equipment, such as surfboards and skis, are unsteady when they are positioned to lean against the wall with the long dimension upright. Only a small force causes them to fall. On the other hand, if disposed on the floor and against the wall, such sports equipment is substantially out of view and, thus, not on display. Previous efforts for the support of sports equipment appear to have been devoted to supporting generally only one type of sports equipment, for example, snow skis. Such stands would not be of broad utility for supporting other sports equipment of various configurations and sizes.

Thus, there is need for a self-supporting rack system configured so that, by employment of various attachments, it can store, protect and display different types of sports equipment. With the suitable attachments, the self-supporting rack system of this invention can support long and short surfboards, as well as alpine and nordic skis, together with their poles. In addition, the self-supporting rack system with its suitable attachments can be employed to store, protect and display snowboards and water skis, including wake skis and kneeboards. Furthermore, the self-supporting rack system with suitable attachments can store, protect and display windsurfing boards, together with their sails, masts and booms. Thus, the self-supporting rack system of this invention is useful for the storage, protection and display of a wide variety of sports equipment by utilization of various attachments.

SUMMARY OF THE INVENTION

In order to aid in the understanding of this invention, it can be stated in essentially summary form that it is directed to a self-supporting rack system for storage, protection and display of sports equipment wherein the rack system comprises at least two upright side bars supported both at a small angle to the vertical and also parallel to each other by a foot on each upright, and maintained in position by two cross bars which engage the side bars.

It is, thus, an object of this invention to provide a self-supporting rack system which stands on the floor and which is configured and sized to permit the display thereon of a wide variety of different sizes and shapes of sports equipment.

It is a further purpose and advantage of this invention to provide a self-supporting rack system which has two identical foot-supported side bars which are supported laterally with respect to each other by means of cross bars. The side bars are generally upright with a small rearward angle with respect to the vertical so that the front thereof can support selected sports equipment, either without a holding strap or before a strap is secured.

It is a further purpose and advantage of this invention to provide a self-supporting rack system which has various types and sizes of attachments so that a wide variety of different types of sports equipment can be stored, protected and displayed thereon.

It is another purpose and advantage of this invention to provide a self-supporting rack system for storage, protection and display of sports equipment wherein the system can be lengthened and otherwise augmented and enlarged by the attachment of one or more additional side bars which are parallel to the initial side bars so that a larger number of sports equipment devices can be stored, protected and displayed thereon.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 4 is an isometric view of an attachment strap.

DESCRIPTION OF THE PREFERRED EMBODIMENTS

Figures 1, 7, 8, 9:
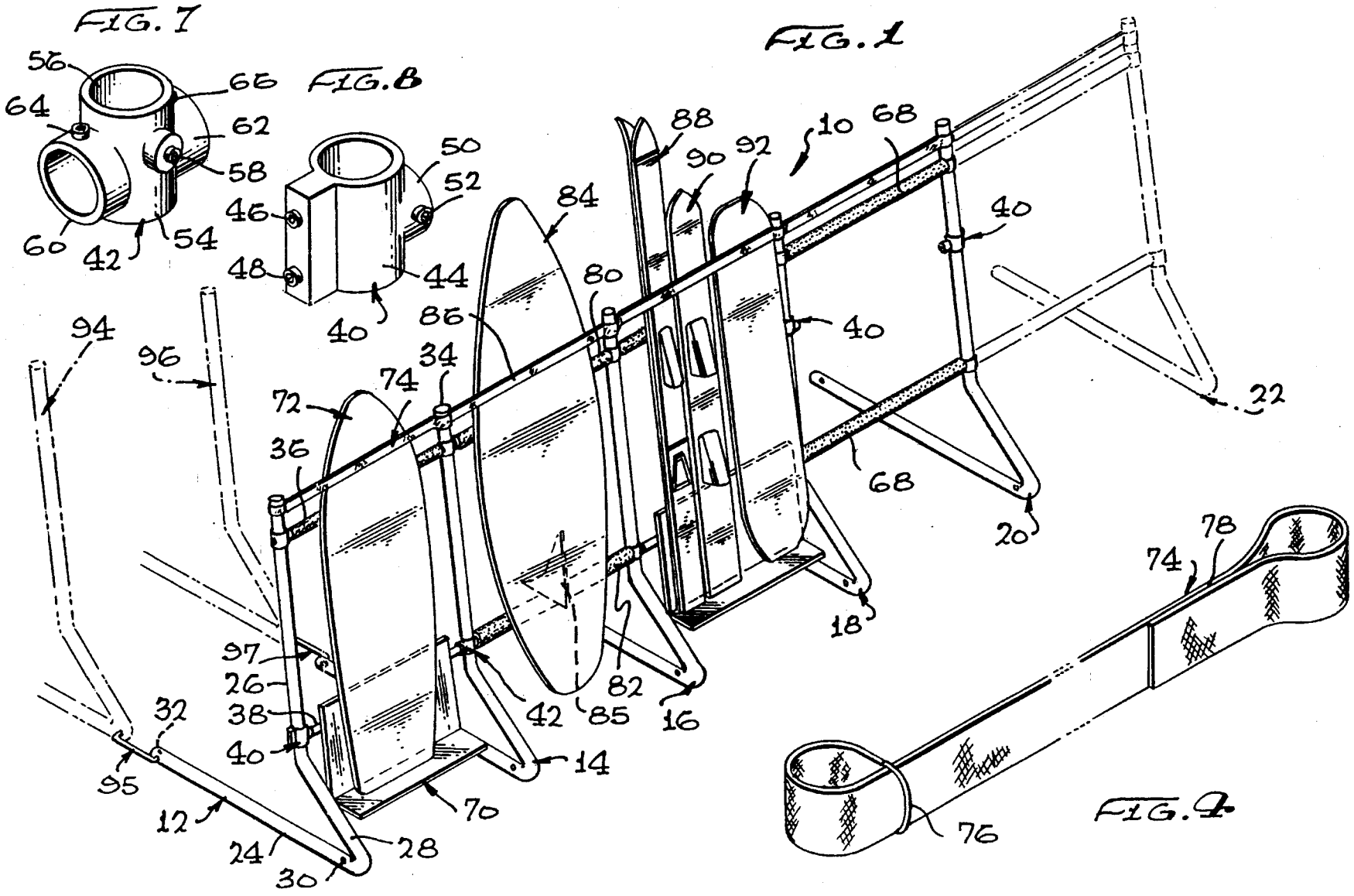
FIG. 1 is an isometric view of the self-supporting rack system for storage, protection and display of sports equipment in accordance with this invention wherein it is shown with a larger number of side bars than the minimum number and shown with several attachments of different styles for supporting different types of sports equipment.
FIG. 7 is an isometric view of a double attachment fitting.
FIG. 8 is an isometric view of a second attachment fitting.
FIG. 9 is a view similar to FIG. 5 showing the rack system of this invention with rear attachments as well as front attachments.
Figure 2:
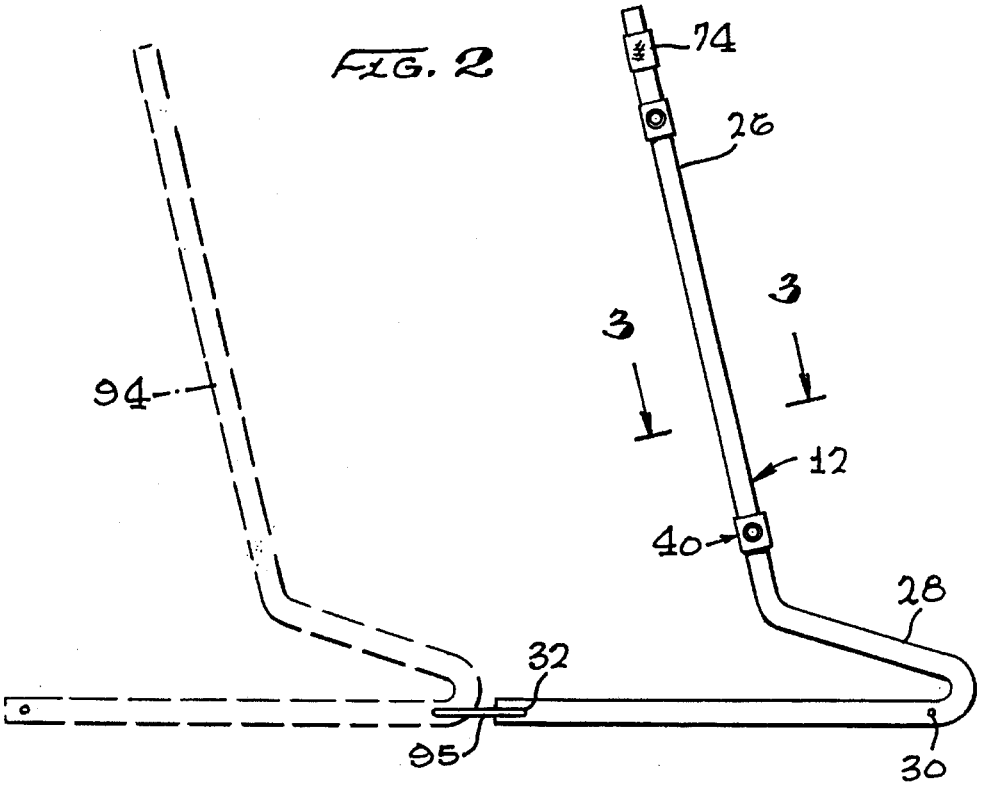
FIG. 2 is an end elevational view of the rack system of this invention, showing a further rack system in dashed lines attached thereto at the rear thereof.

The self-supporting rack system of this invention can take on a number of configurations depending on the number of side bars used and on the attachments employed therewith for the support of particular sports equipment. The rack system indicated generally at 10 in FIG. 1 is comprised of six identical side bars indicated at 12, 14, 16, 18, 20 and 22. The side bar 12 is shown comprised of a foot 24, an upright 26, and joiner 28. As seen in FIG. 1, the side bar 12 can be made of a tube which is bent to shape. The foot 24 is designed to be supported on the floor and, thus, is positioned in a horizontal plane. The joiner 28 holds the upright in a position where it leans back about 15 degrees from the vertical, as is seen in FIG. 2. When the feet of all the side bars are in a horizontal plane, then the uprights are in a plane which leans back about 15 degrees.

Each side bar may be made of rigid synthetic polymer material or bent metallic tube, as is seen in FIG. 2. The foot 24 is straight in order to rest on the flat, horizontal floor or may be slightly arched in the center to make contact only at the ends. The floor contact defines the support plane. The joiner 28 is bent back over the foot to an acute angle. The particular angle is not critical, but should be small enough so that the lower end of upright 26 is close to foot 24 in order to conserve space. Upright 26 is substantially straight and extends upward from the floor plane, but leans back about 15 degrees with respect to the perpendicular to the floor plane. The length of the joiner 28 is such that the center of the upright 26 is slightly back from the perpendicular to the floor plane at the center of the foot 24. While the position of the center of gravity of the sports equipment which will be supported thereon is unknown, it generally will be in front of the upright 26. For the purpose of design, the plane extending upright from the center of foot 24 is about 2 inches in front of the mid-point of upright 26.

Another feature found on each of the side bars is attachment holes on each of the feet. Attachment holes 30 and 32 are shown in FIG. 2 and are positioned adjacent the respective ends of the foot 24. The attachment holes are horizontal and extend through both sides of the tubing of which the foot is formed. The attachment holes are provided to attach various devices to the side bar as described later.

Figure 3:
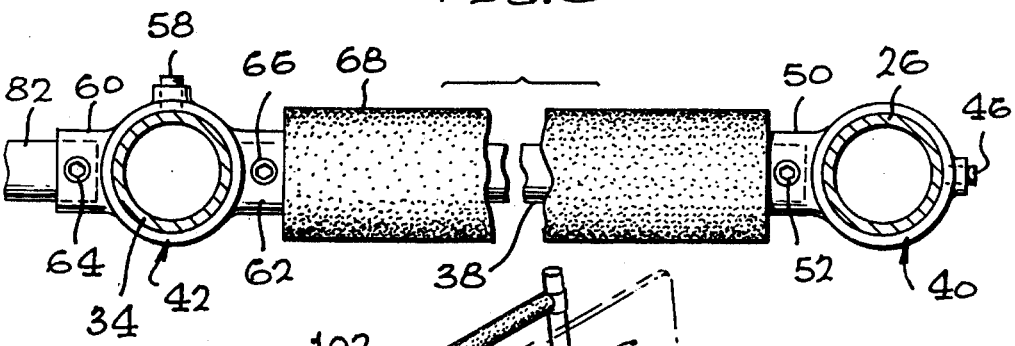
FIG. 3 is an enlarged view taken generally along line 3—3 of FIG. 2, with parts broken away and parts taken in section.

A pair of side bars is necessary to form a portion of the rack system. As is seen in FIG. 1, side bars 12 and 14 cooperate together. Side bar 14 has upright 34, which extends upward parallel to upright 26. The uprights, and consequently the side bars, are attached to each other with at least two cross bars. Upper and lower cross bars 36 and 38 extend between and are secured to the uprights. Single cross bar clamp 40 is seen in FIGS. 1, 2, 3 and 8, and, double cross bar clamp 42 is seen in FIGS. 1, 3 and 7. As seen in FIG. 8, single cross bar clamp 40 has a collar 44, which has an internal hole sized to receive the tubular upright. At least one set screw extends through the collar. Set screws 46 and 48 are seen in FIG. 8. In this way, the collar can be slipped to the proper position on an upright and the set screw tightened to lock the clamp in place. Boss 50 is integrally formed on the side of collar 44 and has an opening therein sized to receive the cross bar 38. Set screw 52 locks the cross bar into the socket in boss 50. The axis of the bore in boss 50 and the axis of the opening through the collar intersect each other and lie at a right angle with respect to each other.

Double cross bar clamp 42, seen in FIGS. 1, 3 and 7, is similar to the clamp 40. Clamp 42 has a collar 54 with an opening 56 therethrough sized to receive the upright 34. Set screw 58 locks the clamp in position at the desired height. Clamp 42 has two bosses 60 and 62, one extending out of each side. The openings in bosses 60 and 62 are sized to receive the cross bars 38 and 82. When a cross bar is in place in a socket in one of the bosses, a set screw holds it in place. Set screws 64 and 66 are shown in FIGS. 3 and 7. The axes of the sockets in the bosses 60 and 62 lie coincident, and the axis of the opening 56 intersects those axes and lies at a right angle with respect thereto. Similar clamps are provided for cross bar 36, as seen in FIG. 1 and elsewhere, so that a rigid structure is created. Padding in the form of a foam tube 68, see FIG. 3, may be positioned on each of the cross bars 36 and/or 38 when needed. The foam tube may be a rigid synthetic polymer composition foam. The purpose of this tube is to prevent scratching or other marring of sports equipment carried on the front of the storage, protection and display rack thus created.

An illustration of utilization of such a rack is seen in FIG. 1. Platform 70 is an L-shaped platform which is welded to crossbar 38 (without a foam tube). The angle of the L-shaped platform 70 with respect to the vertical can be adjusted by rotation of cross bar 38 in clamps 40 and 42. In this position, the base of the L is extending forward, and the base is above the floor plane. In this configuration, the second section of the rack system can support a kneeboard 72. Holding strap 74, seen in detail in FIG. 4, has a fastening ring 76 at one end and a hook and loop fastener 78, such as a Velcro fastener, at the other end. The holding strap 74 is sufficiently long so that it can engage around the sports equipment such as the kneeboard 72. In this way, the kneeboard is held against the cross bars and is supported by the platform. It should be noted that the cross bars 36 and 38 can be adjusted up and down the uprights by means of their clamps 40 and 42 to the desired position for proper support of the kneeboard or any other equipment and the strap can be wrapped around the upright or pre-positioned anywhere along the length of the upright.

Upper and lower cross bars 80 and 82 extend between the side bars 14 and 16. They are engaged in double attachment fittings or clamps, such as those shown in FIG. 7. Thus, the side bar 16 is secured in position, and the cross bars can be adjusted in height to the desired location, as previously described. In this case, surfboard 84 is stored, protected and displayed on the rack defined by side bars 14 and 16. Since it has a fin 85 on the back and the fin is engaged over the lower cross bar 82, no platform is needed. However, a holding strap 86 (same as strap 74) is employed to hold the surfboard 84 in place against its supporting cross bars.

In the portion of the rack system defined by side bars 16 and 18, cross bars are employed in the same manner, together with a platform the same as platform 70 in the nearest section of the rack system seen in FIG. 1. In this case, a pair of snow skis 88, single water ski 90 and a snowboard 92 are supported on the platform and held in place by a strap. Similar ski equipment could be retained for storage and display in the same manner. Additional sections of the self-supporting rack system of this invention are shown in FIG. 1. It is clear that as many sections as desired can be attached side-to-side.

In addition, FIGS. 1 and 2 show that the rack system can be multiplied in a front-to-back direction. Side bars 94 and 96 are shown in FIG. 1 as respectively being positioned behind side bars 12 and 14. Attachment bolts 95 and 97 respectively engage through the rear attachment holes in uprights 12 and 14 and front attachment holes in uprights 94 and 96, and may have retention nuts. The attachment bolts retain the several side bars in lateral position with respect to each other. The side bars 94 .and 96 require cross bars to make them useful for storage and display of the sports equipment. However, these side bars show that front-to-back orientation, as well as front-to-front or back-to-back, is also possible for multiplying the self-supporting rack system. Each of the side bars rests on the floor.

Figure 5:
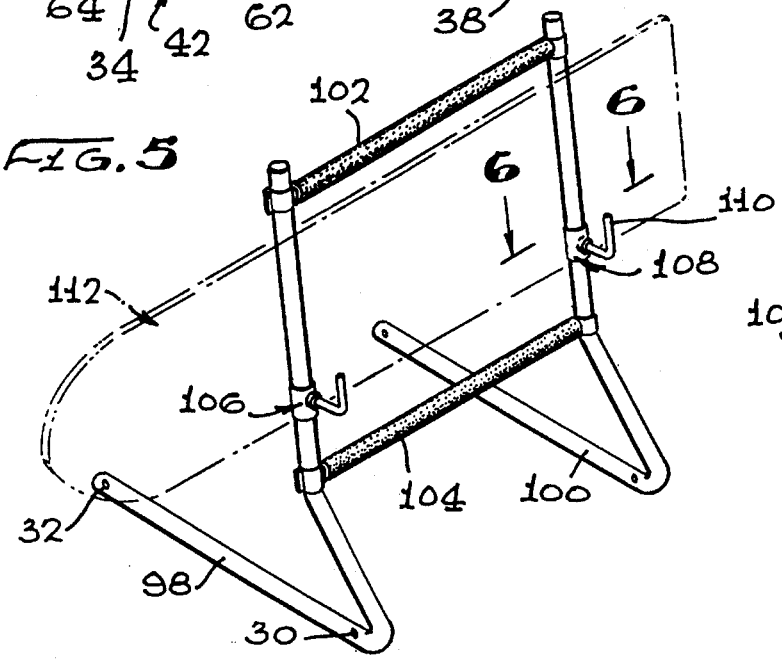
FIG. 5 is an isometric view of a simple configuration of the self-supporting rack system for sports equipment of this invention, a sport board being shown in broken lines.
Figure 6:
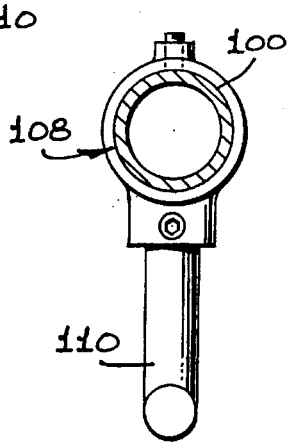
FIG. 6 is an enlarged section taken generally along line 6—6 of FIG. 5, with parts broken away.
Figure 9:
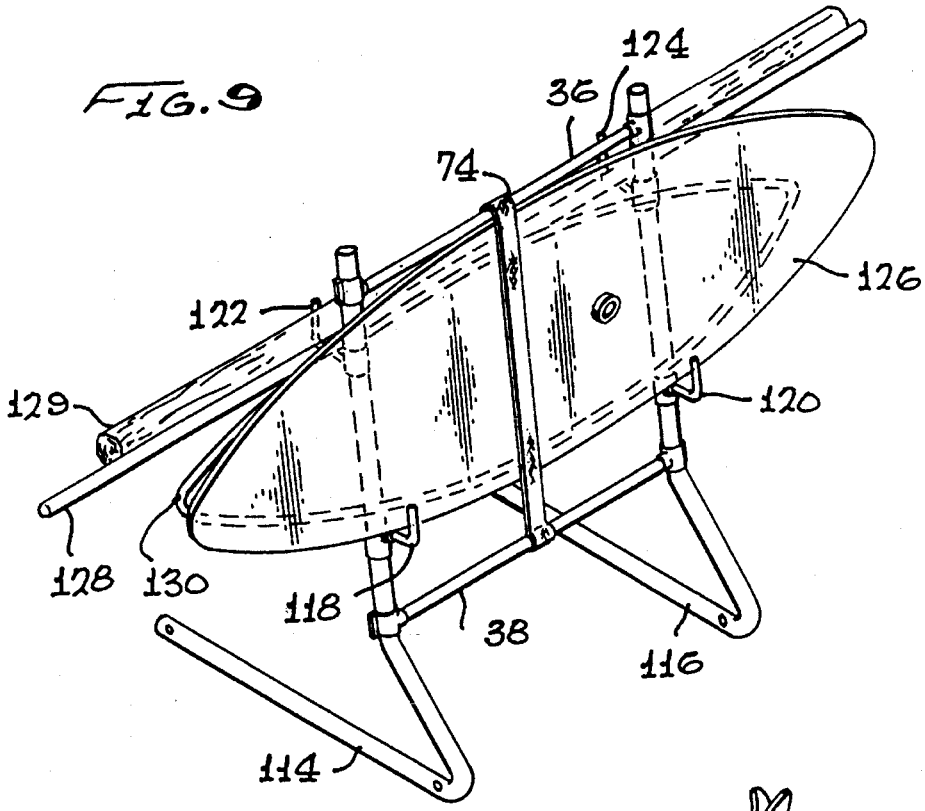

FIG. 5 shows a self-supporting rack system of two side bars 98 and 100 which carry upper and lower cross bars 102 and 104. These are the same as the side bars and cross bars previously described. In this case, support hooks indicated generally at 106 and 108 are respectively mounted on the uprights of side bars 98 and 100. The support hooks are the same, and the support hook 108 is shown in more detail in FIG. 6. It comprises a collar, boss and set screw the same as single cross bar clamp 40. In fact, it can be the same physical structure. The boss receives hook 110, which is bent into an L-shape and which is preferably made of the same stock as cross bar 38. The L-shaped hook 110 is positioned to be open in the upward direction. The two support hooks 106 and 108 may be positioned at the same height on their respective uprights or may be positioned at different heights depending upon the sports equipment supported. Multiple support hooks may be used, pointed in different directions. The sports board 112 is shown in broken lines for clarity and as having straight, parallel edges; thus, for horizontal support of the board 112, the hooks 106 and 108 are positioned at the same height, and the board 112 is rested thereon.

FIG. 9 shows a self-supporting rack system for the storage, protection and display of sports equipment configured very much like the rack system shown in FIG. 5. The rack system of FIG. 9 shows side bars 114 and 116 joined together by upper and lower cross bars 36 and 38. In addition, support hooks 118 and 120 are positioned on the uprights with their hooks facing forward, the same as support hooks 106 and 108. However, when employed as shown, the side bars 114 and 116 carry additional support hooks 122 and 124, which are of the same construction as support hook 108. The support hooks 122 and 124 are positioned so that they extend rearwardly from the side bars. When the rack system is configured in this way, it can hold a windsurfing board 126 on the front and can hold the mast 128 and rolled-up sail 129 on the rear support hooks 122 and 124. In addition, the windsurfer boom 130, which is configured as a substantially rigid elongated hoop, can also be supported on hooks 122 and 124. One or more holding straps 74 can be used.

Figure 10:
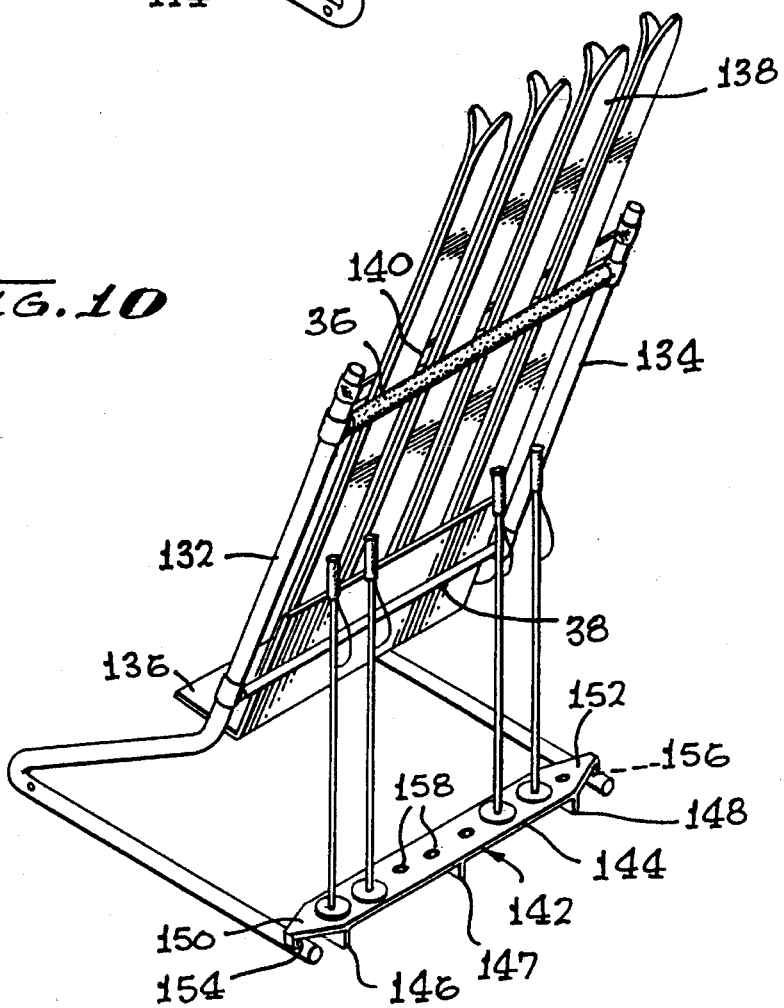
FIG. 10 is a rear isometric view of the rack system of this invention, showing it configured for the support of snow skis and ski poles.

FIG. 10 is a rear isometric view of a self-supporting rack system having side bars 132 and 134. The side bars are configured in the same way as previously described, and upper and lower cross bars 36 and 38 are engaged thereon to define a rigid rack system. A platform 136 with its welded lower cross bar 38 is used to support several pairs of skis, such as the pair shown at 138. A holding strap 140, the same as strap 74, holds the skis in place. Snow skis, both downhill or Alpine and Nordic, usually have associated with them a pair of ski poles. It is desirable to store and display the ski poles together with their associated skis. To accomplish this, ski pole holder 142 is provided. The ski pole holder is a stiff platform 144 with feet therebelow. Feet 146, 147 and 148 are indicated in FIG. 10. The platform 144 is provided with hooks 150 and 152, which respectively engage in holes 154 and 156 toward the back of the foot of each side bar. These holes are the same as the connecting hole 32 previously described. Ski pole tip holes 158 are provided in the platform to receive the tips of the ski poles, as indicated. These ski pole tip holes fairly closely fit the ski pole tips to hold them in the upright position. In this way, the ski poles are stored and displayed along with their skis.

Although not described in detail, some portions of the illustrated rack system are covered with a protective coating, such as conventional polymers, and other portions can be covered similarly.

The self-supporting rack system can store and display many different types of sports equipment, as illustrated. The platforms and hooks can be adjusted to accommodate different dimensions of sports equipment. In addition, the rack system protects the sports equipment from being damaged as by falling down or being accidentally hit or tripped over. The self-supporting rack system as thus described has a number of significant benefits. The system is adjustable and adaptable to accommodate sports equipment for many different types of sports, as listed above. Not only can this rack system be modified to hold simultaneously five or more different types of sporting equipment, but the rack system can be expanded to hold any desired quantity of sports equipment. The side bars are sequentially attached to each other by suitable cross bars so that the self-supporting rack system can be expanded or configured to the configuration which is required for particular needs. In this way, a wide variety of sports equipment can be stored, protected and displayed simultaneously on the self-supporting rack system.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A self-supporting rack system for storage, protection and display of sports equipment comprising:

first and second side bars, each of said side bars being formed of a single length of bent tubing so that each of said side bars has a foot for support on a horizontal surface and has an upwardly directed upright member, each said side bar having an integral connector between said foot and said upright member;

upper and lower cross bars, each of said and lower cross bars respectively connected between said side bars, said upper cross bar having first and second ends, a cross bar clamp on each of said first and second ends, each said cross bar clamp being adjustably attached to a respective one of said uprights of said side bars so that said upper cross bar is adjustable upward and downward on said uprights, said uprights lying close to and being acutely angled away from a vertical plane when said feet are on a horizontal plane, said cross bars and said side bars forming a rack, said cross bars having padding thereon so that sports equipment stored thereagainst is protected against damage; and attachment means for detachably storing, protecting and displaying sports equipment on said rack.

2. A self-supporting rack system for storage, protection and display of sports equipment comprising:

first and second side bars, each of said side bars being formed of a single length of bent tubing so that each of said side bars has a foot for support on a horizontal surface and has an upwardly directed upright member, each said side bar having an integral connector between said foot and said upright member;

Upper and lower cross bars, each of said upper and lower cross bars respectively connected between said side bars, said upper cross bar having first and second ends, a cross bar clamp on each of said first and second ends, each said cross bar clamp being adjustably attached to a respective one of said uprights of said side bars so that said upper cross bar is adjustable upward and downward on said uprights, said uprights lying close to and being acutely angled away from a vertical plane when said feet are on a horizontal plane, said cross bars and said side bars forming a rack; and attachment means for detachably storing, protecting and displaying sports equipment on said rack, said attachment means comprising at least one holding strap selectively engaged between selected pairs of said uprights of said first and second side bars and said cross bars.

3. The rack system of claim 2 wherein said attachment means comprises a platform attached to said lower cross bar for supporting sports equipment above the floor.

4. A self-supporting rack for storage, protection and display of sports equipment comprising:

first and second side bars, each said side bar being formed of bent tubing so as to respectively define a foot, an upright and a connector between said foot and said upright, said uprights being spaced from each other with said feet for support on a substantially planar floor;

upper and lower cross bars, at least one of said cross bars being padded to protect sports equipment displayed thereon from damage, said upper and lower cross bars each having first and second ends, said first and second ends of said cross bars being positioned adjacent said uprights of said first and second side bars; and a corresponding plurality of cross bar clamps engaging said first and second ends of said upper and lower cross bars and engaging the adjacent uprights, said clamps being movable up and down said uprights to adjustably position said cross bars with respect to said uprights, said clamps being securable to said uprights and said cross bars so as to form a substantially rigid rack, said uprights of said first and second side bars lying substantially in a plane and said plane lying at an acute angle with respect to a plane positioned at a right angle with respect to said foot plane.

5. The rack of claim 4 further including securement means for detachably securing sports equipment on said rack for storage, protection and display.

6. The rack of claim 5 wherein said securement means comprises at least one holding strap selectively engaged between selected pairs of said uprights of said first and second side bars and said cross bars.

7. The rack of claim 4 further including a platform mounted on said lower cross bar to support sports equipment for storage, protection and display above the floor.

* * * * *